US009633803B2

(12) United States Patent
Wang

(10) Patent No.: US 9,633,803 B2
(45) Date of Patent: Apr. 25, 2017

(54) KEYBOARD BACKLIGHT MODULE WITH IMPROVED LIGHT GUIDE STRUCTURE

(71) Applicant: CHICONY POWER TECHNOLOGY CO., LTD., New Taipei (TW)

(72) Inventor: Pai-Hsiang Wang, New Taipei (TW)

(73) Assignee: Chicony Power Technology Co., Ltd., New Taipei (TW)

( * ) Notice: Subject to any disclaimer, the term of this patent is extended or adjusted under 35 U.S.C. 154(b) by 12 days.

(21) Appl. No.: 14/789,563

(22) Filed: Jul. 1, 2015

(65) Prior Publication Data

US 2017/0004935 A1 Jan. 5, 2017

(51) Int. Cl.
*H01H 13/02* (2006.01)

(52) U.S. Cl.
CPC ..... *H01H 13/023* (2013.01); *H01H 2219/036* (2013.01); *H01H 2219/06* (2013.01); *H01H 2219/062* (2013.01)

(58) Field of Classification Search
CPC ..... H01H 13/023; H01H 2219/036; H01H 2219/06; H01H 2219/062
See application file for complete search history.

(56) References Cited

U.S. PATENT DOCUMENTS

2002/0122683 A1* 9/2002 Kamei ..... G06F 1/1616 400/472
2009/0128496 A1* 5/2009 Huang ..... G06F 3/0202 345/170
2014/0133138 A1* 5/2014 Chang ..... F21S 9/037 362/158
2014/0166456 A1* 6/2014 Chen ..... H01H 13/83 200/5 A
2015/0036314 A1* 2/2015 Cheng ..... H01H 13/83 362/23.03

* cited by examiner

*Primary Examiner* — Anabel Ton
(74) *Attorney, Agent, or Firm* — Muncy, Geissler, Olds & Lowe, P.C.

(57) ABSTRACT

A keyboard backlight module includes a backlight device including a reflective layer, a light shielding layer and a light guide layer sandwiched between the reflective layer and the light shielding layer and carrying a set of key switches on the top surface thereof, a light source mounted between the reflective layer and the light shielding layer, and high-refractive index scatter points prepared from a mixture containing a colored light-transmissive ink and high-refractive index particles at a predetermined ratio and mounted in the top side and/or bottom side of the light guide layer for refracting light toward the key switches to enhance illumination brightness.

8 Claims, 6 Drawing Sheets

KEYBOARD BACKLIGHT MODULE WITH IMPROVED LIGHT GUIDE STRUCTURE

BACKGROUND OF THE INVENTION

1. Field of the Invention

The present invention relates to keyboard technology and more particularly, to a keyboard backlight module with improved light guide structure, which has high-refractive index scatter points mounted in the top surface and or bottom surface of a light guide layer of a backlight device between a reflective layer and a light shielding layer for refracting light to enhance the illumination brightness.

2. Description of the Related Art

With fast development of the modern technology, many different kinds of works, including word processing, photos and graphics editing and etc. are implemented through a computer. A computer can also be linked to the Internet for information search, online shopping, online meeting, data download, playing online video games, and many other applications. When operating a computer, different peripheral apparatuses may be used for different application purposes. In addition to the host and monitor, a computer system also needs to use a keyboard and a mouse as requisite tools. A computer keyboard uses a set of key switches for allowing the user to input control signals, text, numerals and other data into the host for processing.

Further, a computer keyboard may equipped with a backlight module for emitting light to each key switch so that the user can clearly identify the location of the key that is duly pressed. FIG. 6 illustrates a keyboard backlight module according to the prior art. According to this design, the backlight module A comprises a light guide panel A1, a reflective panel A2 located at the bottom side of the light guide panel A1, a light shielding panel A4 located at the top side of the light guide panel A1, a light source A3 mounted in the light guide panel A1 between the reflective panel A2 and the light shielding panel A4 for emitting light into the light guide panel A1, and a plurality of reflecting points A11 mounted on the bottom surface of the light guide panel A1. During operation of the backlight module A, light rays S emitted by the light source A3 fall upon the light guide panel A1 and are then refracted by the light guide panel A1 onto the reflecting points A11, and then reflected by the reflecting points A11 toward the light shielding panel A4 so that the reflected light rays S1 can go to the outside through holes in the light shielding panel A4 to illuminate the respective key switches. However, when light rays S are reflected by the reflecting points A11 toward the top side of the light guide panel A1, a part of the reflected light rays S2, S3, S4 will be reflected backwards by the top wall of the light guide panel A1, resulting in weakened illumination brightness. Further, the energy of the reflected light rays S2, S3, S4 can be absorbed by the light guide panel A1, causing light attenuation and energy loss problems and insufficient illumination. Further, because the reflecting points A11 are mounted on the bottom surface of the light guide panel A1, the reflected light rays S2, S3, S4 must travel along a long reflection path before reaching the light shielding panel A4, and thus, the light rays can be diffused in the border area or absorbed and attenuated by the light guide panel A1, affecting the lighting performance of the backlight module A. An improvement is necessary.

Therefore, it is desirable to provide a keyboard backlight module, which shortens the reflection path, prevents loss of light energy, and greatly enhances the illumination brightness.

SUMMARY OF THE INVENTION

The present invention has been accomplished under the circumstances in view. It is therefore the main object of the present invention to provide a keyboard backlight module, which prevents loss of light energy and greatly enhances the illumination brightness.

To achieve this and other objects of the present invention, a keyboard backlight module comprises a backlight device, which comprises a reflective layer, a light shielding layer and a light guide layer sandwiched between the reflective layer and the light shielding layer and carries a set of key switches on the top surface thereof, a light source mounted between the reflective layer and the light shielding layer, and high-refractive index scatter points prepared from a mixture containing a light-transmissive ink and high-refractive index particles at a predetermined ratio and mounted in the top side and/or bottom side of the light guide layer for refracting light toward the key switches to enhance illumination brightness.

Further, the light-transmissive ink in the high-refractive index scatter points can be a colored ink of yellow, red, blue, green or other color so that the high-refractive index particles can refract, reflect or disuse incident light through the colored light-transmissive ink to produce a color lighting effect.

Further, the high-refractive index scatter points can be positioned in the light guide layer by one of the techniques of printing, vapor deposition, adhesion or embedded processing process. Preferably, the high-refractive index particles of the high-refractive index scatter points are added to the light-transmissive ink at a ratio about 0.1~50%. Further, the high-refractive index particles can be selected from the group of oxides such as silica ($SiO_2$), alumina ($Al2O_3$) or titanium dioxide ($TiO_2$), nitrides such as aluminum nitride (AlN), or diamonds.

Further, the high-refractive index particles are in the size range of 0.1~20 μm.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
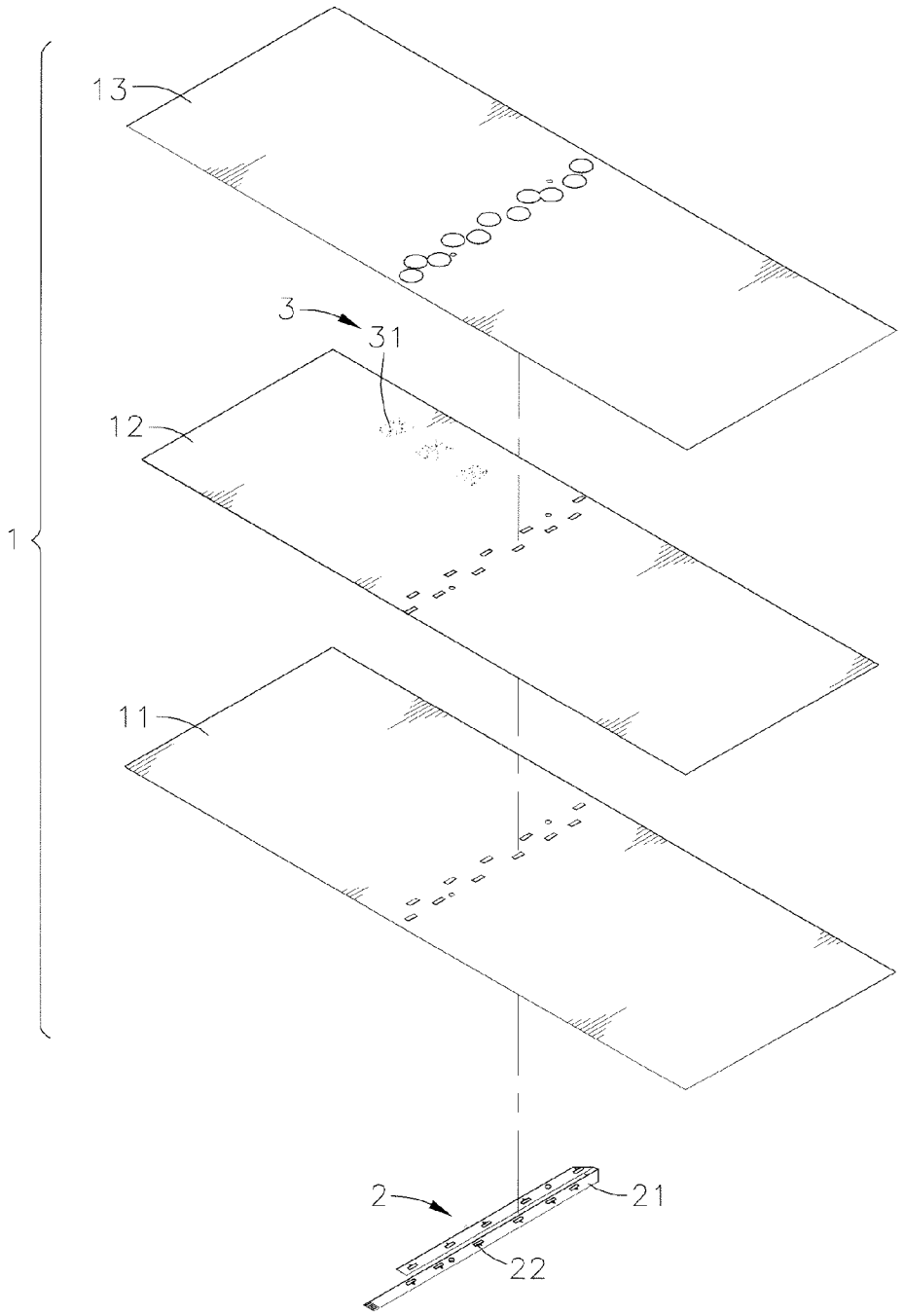
FIG. 1 is an exploded view of a keyboard backlight module in accordance with the present invention.
Figure 2:
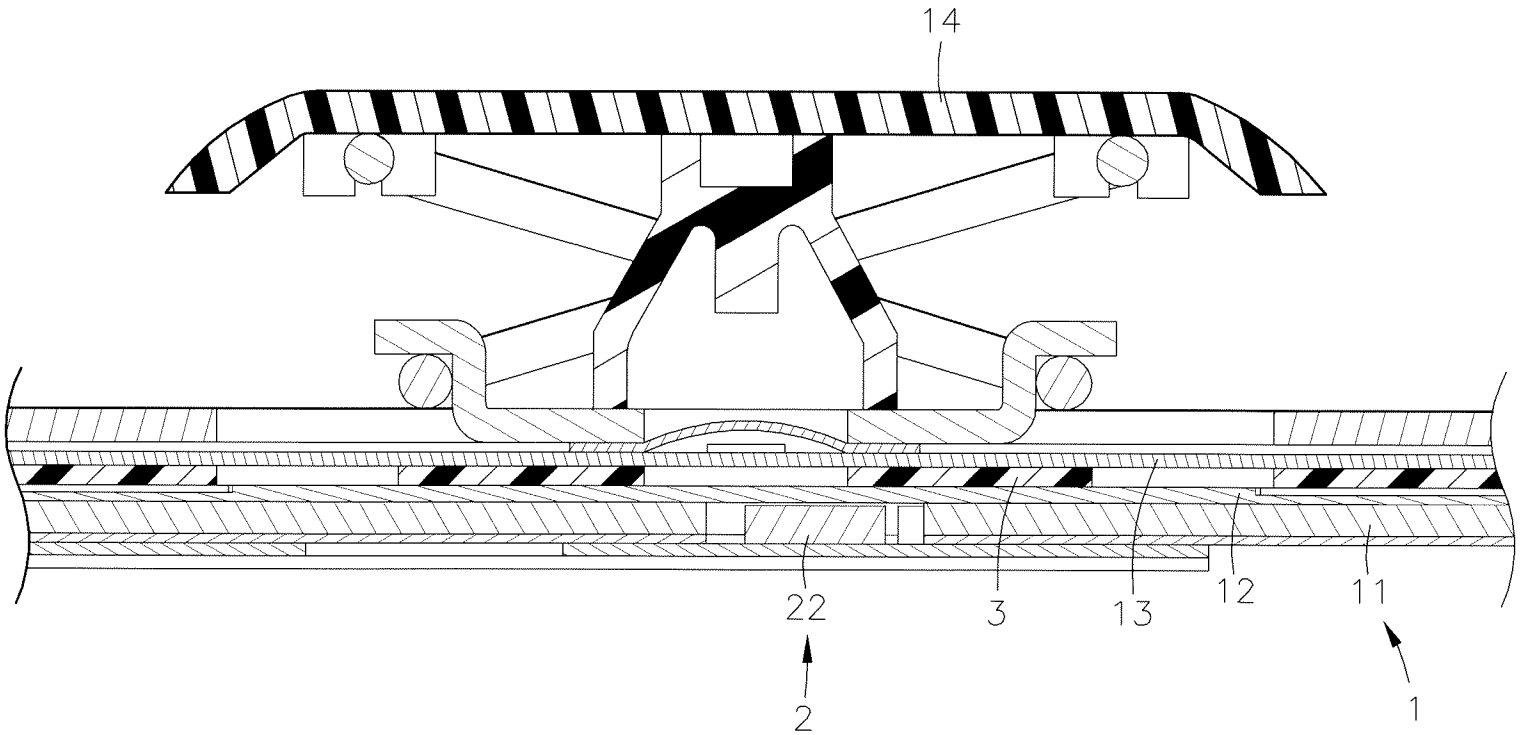
FIG. 2 is a sectional side view of the present invention, illustrating key switches mounted at the top side of the light shielding layer of the backlight device of the keyboard backlight module in accordance with the present invention.
Figure 3:
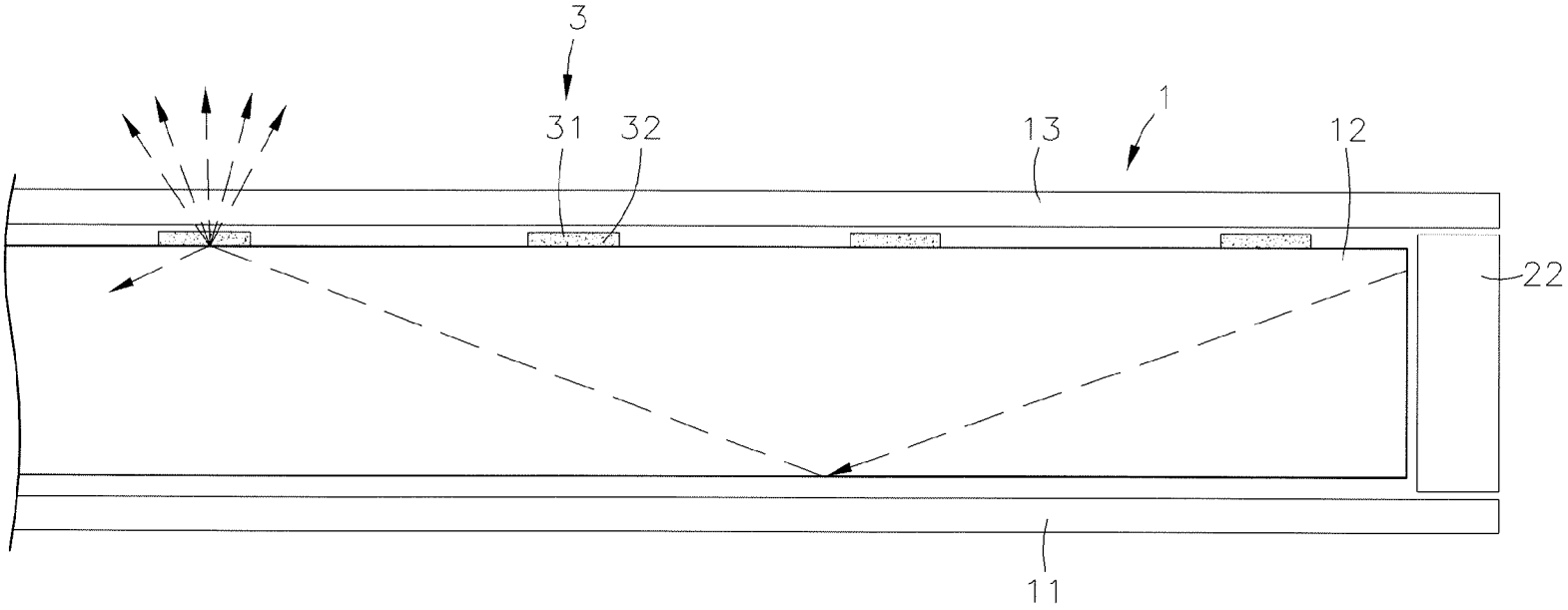
FIG. 3 is a schematic side view of the present invention, illustrating an operating status of the keyboard backlight module in accordance with the present invention.

Referring to FIGS. 1-3, a keyboard backlight module in accordance with the present invention is shown. The keyboard backlight module comprises a backlight device 1, a light source 2, and a plurality of high-refractive index scatter points 3.

The backlight device 1 comprises a reflective layer 11, a light guide layer 12 and a light shielding layer 13 arranged in a stack through lamination. The light guide layer 12 is set between the reflective layer 11 and the light shielding layer 13. The light shielding layer 13 carries a set of key switches 14.

The light source 2 comprises a circuit board 21 carrying a circuit layout, and a plurality of light-emitting devices 22 mounted in the circuit board 21. The light-emitting devices 22 can be, for example, light-emitting diodes (LEDs).

The high-refractive index scatter points 3 are prepared from a mixture containing a light-transmissive ink 31 and high-refractive index particles 32 at a predetermined ratio.

In installation, the circuit board 21 of the light source 2 is bonded to a top surface of the reflective layer 11 of the backlight device 1, and then the light guide layer 12 of the backlight device 1 is mounted at the circuit board 21 and the reflective layer 11 at a top side above the light-emitting devices 22, and then the high-refractive index scatter points 3 are mounted in a top surface of the light guide layer 12 opposite to the reflective layer 11, and then the light shielding layer 13 is mounted on the high-refractive index scatter points 3 at a top side opposite to the light guide layer 12. Thus, the backlight device 1, the light source 2 and the high-refractive index scatter points 3 are assembled together, constituting the expected keyboard backlight module with improved light guide structure, wherein the light-emitting devices 22 face toward the light guide layer 12 and the light shielding layer 13. In operation, the emitted light of the light-emitting devices 22 can be reflected by the reflective layer 11 and then refracted by the high-refractive index scatter points 3 toward the light shielding layer 13, enhancing the brightness of the light source and the effect of heat dissipation.

As stated above, the high-refractive index scatter points 3 are prepared from a mixture containing a light-transmissive ink 31 and high-refractive index particles 32 at a predetermined ratio. The light-transmissive ink 31 can be a transparent ink, or other suitable ink that admits light. The high-refractive index scatter points 3 are joined to the surface of the light guide layer 12 of the backlight device 1 by printing, vapor deposition, adhesion or embedded processing process. The high-refractive index particles 32 can be selected from the group of oxides [for example, silica ($SiO_2$), alumina ($Al2O_3$) or titanium dioxide ($TiO_2$)], nitrides [for example, aluminum nitride (AlN)] and diamonds. Further, the high-refractive index particles 32 can be added to the light-transmissive ink 31 at a ratio about 0.1~50%. Further, the particle size of the high-refractive index particles 32 can be in the range of 0.1~20 μm, depending on the location of the high-refractive index scatter points 3 on the surface of the light guide layer 12 for creating different refraction effects and providing an optimal light scattering function.

Further, the high-refractive index scatter points 3 are positioned in the top surface of the light guide layer 12 of the backlight device 1 by printing, vapor deposition, adhesion or embedded processing process. When the light-emitting device 22 of the circuit board 21 of the light source 2 emit light onto different locations at the backlight device 1 (such as center, left side, right side, bottom side), the emitted light rays are transferred through the light guide layer 12 to the high-refractive index scatter points 3, and then refracted or reflected by the high-refractive index particles 32 of the high-refractive index scatter points 3 through the light-transmissive ink 31 toward the light shielding layer 13, preventing the light rays from being reflected back to the light guide layer 12 or reflective layer 11 to cause loss of light energy. Thus, the light reflection, refraction travel path can be significantly reduced to avoid light loss due to a reversed reflection. Further, the high-refractive index particles 32 in the high-refractive index scatter points 3 greatly enhances the light scattering effect and light refracting, reflecting and diffusing performance of the high-refractive index scatter points 3 so that the brightness of the emitted light can be greatly increased.

Referring to FIGS. 1-5, an exploded view of the keyboard backlight module, a sectional side view of the keyboard backlight module, a schematic operational side view of the keyboard backlight module, another schematic operational side view of the keyboard backlight module and still another schematic operational side view of the keyboard backlight module in accordance with the present invention are shown. As illustrated, the light-transmissive ink 31 in the high-refractive index scatter points 3 can be a transparent ink, or a colored ink of yellow, red, blue, green or other color so that the high-refractive index particles 32 can refract, reflect or disuse incident light through the colored light-transmissive ink 31 to produce a color lighting effect. Thus, the high-refractive index scatter points 3 can be differently configured for refract, reflect or disuse incident light into different colors of light to illuminate different key switches 14 at different locations on the top surface of the light shielding layer 13 of the backlight device 1, enabling the user to easily identify the key switches 14 been duly pressed. For example, different colors of high-refractive index scatter points 3 can be arranged beneath different functional key switches 14 in a particular area for different functional applications (for example, key switches for manipulating direction of movement, jumping, launch or other functions in a computer video game.) Thus, when a key switch 14 in this particular area is pressed, a different color of light can be produced to give a visual indication, facilitating quick identification of the key switch location.

Figure 4:
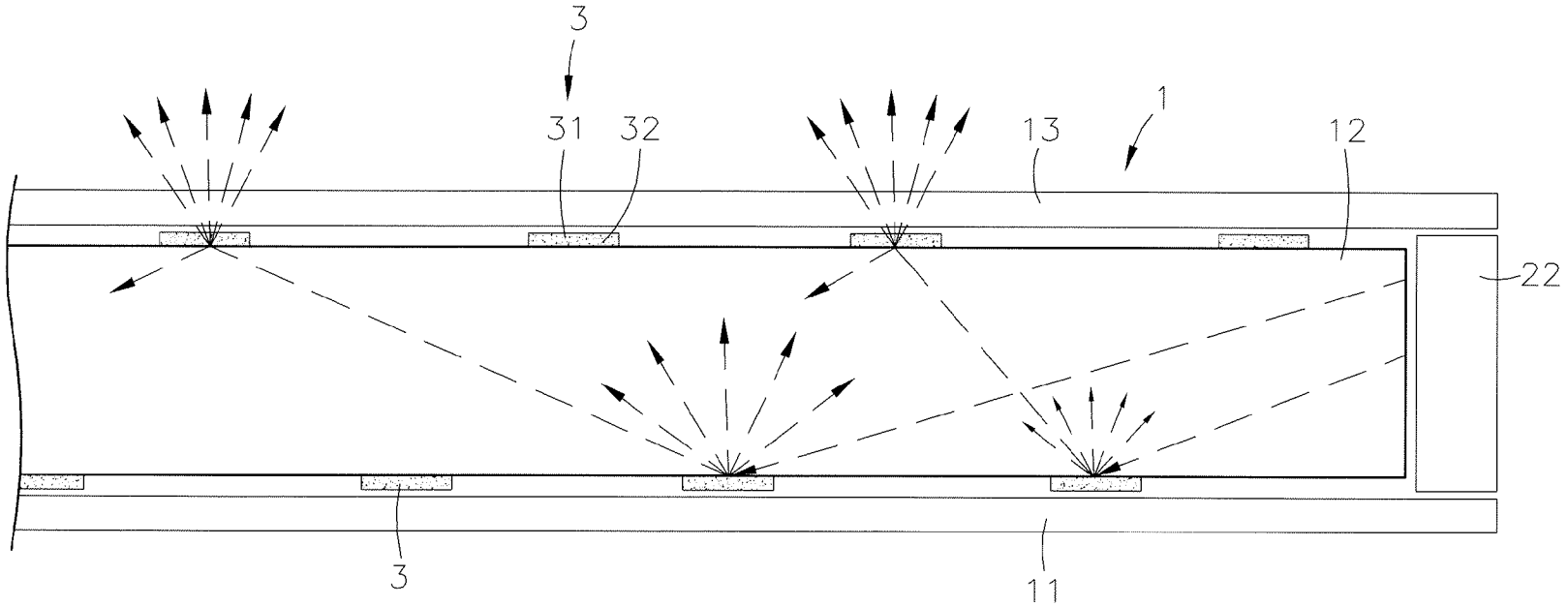
FIG. 4 is a schematic side view of the present invention, illustrating another operating status of the keyboard backlight module in accordance with the present invention.
Figure 5:
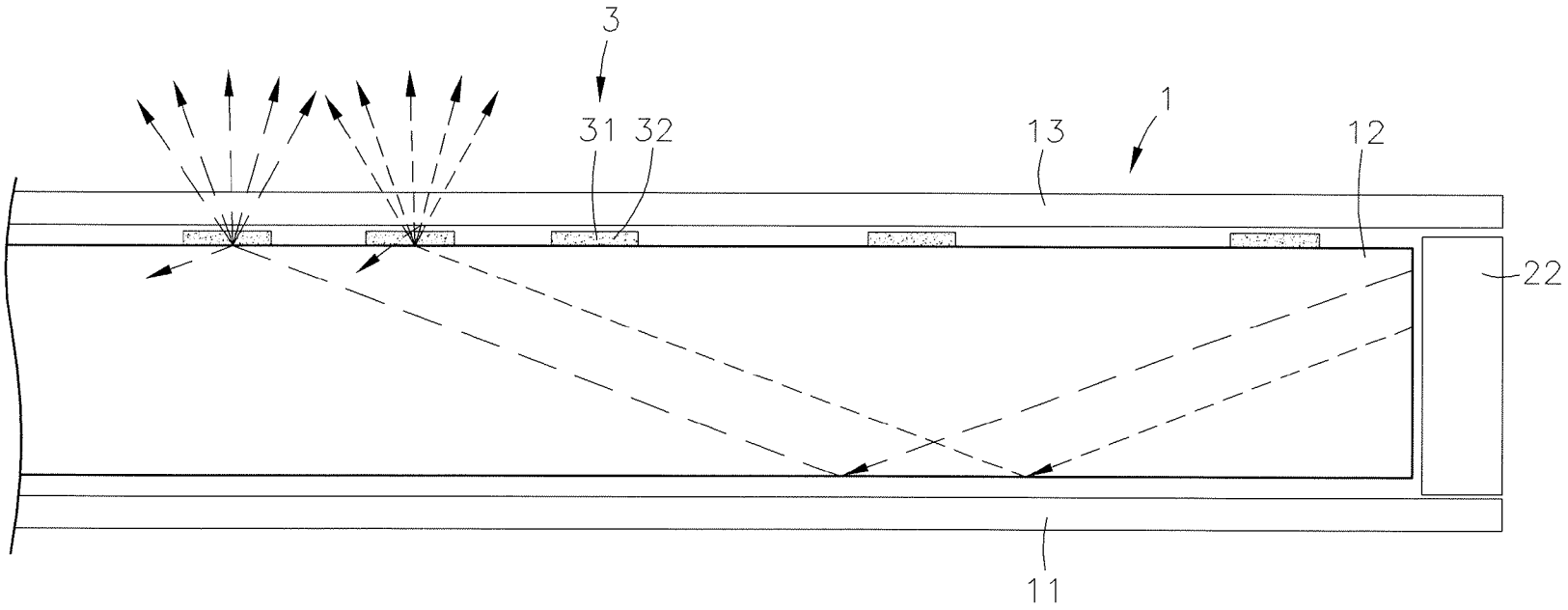
FIG. 5 is a schematic side view of the present invention, illustrating still another operating status of the keyboard backlight module in accordance with the present invention.
Figure 6:
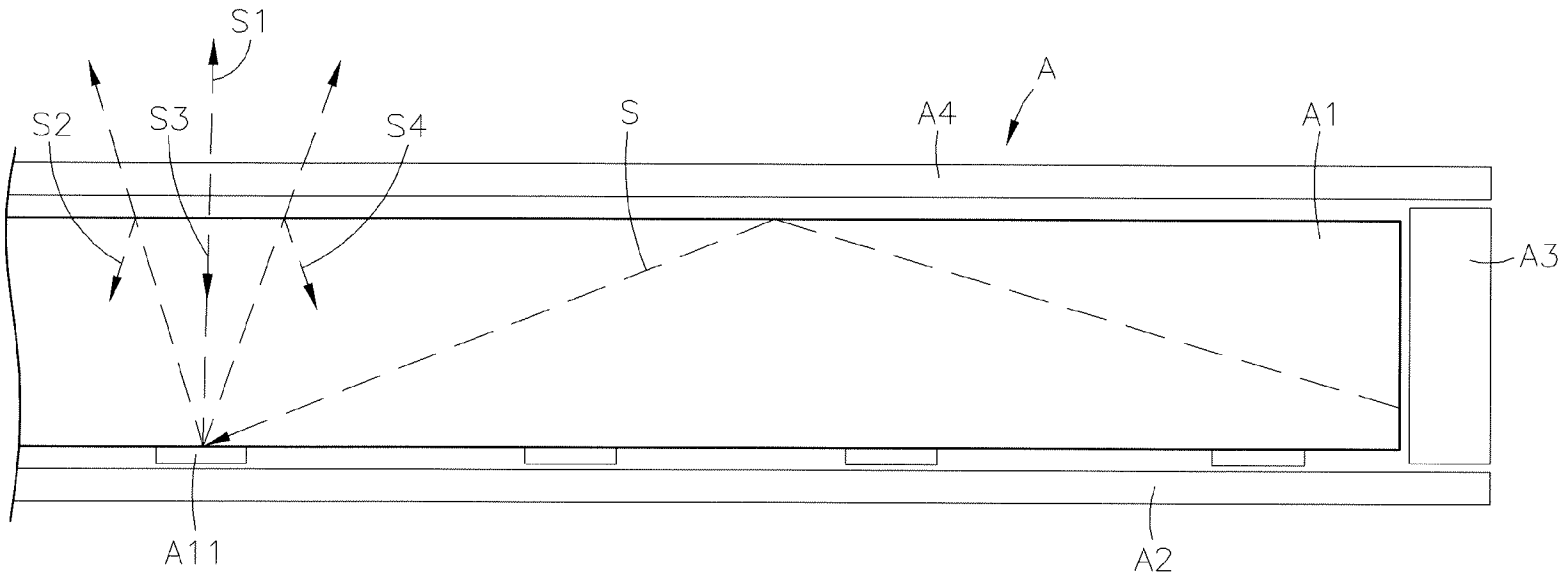
PRIOR ART FIG. 6
FIG. 6 is a schematic side view illustrating an operating status of a keyboard backlight module according to the prior art.

Further, the high-refractive index scatter points 3 can be simply mounted in the top surface of the light guide layer 12 of the backlight device 1, as shown in FIG. 3. Alternatively, the high-refractive index scatter points 3 can be mounted in the top surface of the light guide layer 12 of the backlight device 1 as well as the opposing bottom surface of the light guide layer 12 of backlight device 1, as shown in FIG. 4, where the high-refractive index scatter points 3 in the top surface of the light guide layer 12 and the high-refractive index scatter points 3 in the bottom surface of the light guide layer 12 are disposed in a staggered asymmetric relationship. Thus, when the light-emitting devices 22 of the light source 2 are driven to emit light toward the light guide layer 12, the light going through the light guide layer 12 is directly reflected or refracted by the high-refractive index scatter points 3 at the top side of the light guide layer 12 toward the key switches 14, or reflected by the reflective layer 11 and then refracted by the high-refractive index scatter points 3 at the bottom side of the light guide layer 12 toward the key switches 14, and thus, the key switches 14 can be brightly illuminated.

In conclusion, the invention provides a keyboard backlight module with improved light guide structure, which comprises a backlight device 1 that comprises a reflective layer 11, a light shielding layer 13 and a light guide layer 12 sandwiched between the reflective layer 11 and the light shielding layer 13 that carries a set of key switches 14 on the top surface of the light shielding layer 13 thereof, a light source 2 consisting of a plurality of light-emitting devices 22 and mounted in the light guide layer 12 between the reflective layer 11 and the light shielding layer 13, and high-refractive index scatter points 3 prepared from a mixture containing a colored light-transmissive ink 31 and high-refractive index particles 32 at a predetermined ratio and mounted in the top side and/or bottom side of the light guide layer 12 for refracting light toward the key switches 14 to enhance illumination brightness. During the operation of the keyboard backlight module, the light emitted by the light-emitting devices 22 of the light source 2 goes into the inside of the light guide layer 12 and is then guided by the light guide layer 12 to the high-refractive index scatter points 3 where the high-refractive index particles 32 of the high-refractive index scatter points 3 refract the light through the light-transmissive ink 31 onto the light shielding layer 13 to illuminate the key switches 14. Thus, the functioning of the high-refractive index scatter points 3 greatly shortens the light path, preventing loss of light energy and greatly enhancing the illumination brightness. Further, the light-transmissive ink 31 of the high-refractive index scatter points 3 can be prepared in any of a variety of colors so that different colors of light can be provided to illuminate different key switches 14 at different locations on the top surface light shielding layer 13 of the backlight device 1, enabling the user to easily identify the key switches 14 been duly pressed.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A keyboard backlight module, comprising a backlight device, a light source and a plurality of high-refractive index scatter points, wherein:

said backlight device comprises a reflective layer, a light guide layer and a light shielding layer arranged in a stack through lamination, said light guide layer being set between said reflective layer and said light shielding layer, said light shielding layer carrying a set of key switches on a top surface thereof;

said light source comprises a circuit board carrying a circuit layout and bonded to a top surface of said reflective layer of said backlight device, and a plurality of light-emitting devices mounted in said circuit board and disposed between said reflective layer and said light shielding layer;

said high-refractive index scatter points are mounted in at least one of opposing top and bottom surfaces of said light guide layer and prepared from a mixture containing a light-transmissive ink and high-refractive index particles at a predetermined ratio.

2. The keyboard backlight module as claimed in claim 1, wherein said high-refractive index scatter points are positioned in said light guide layer by one of the techniques of printing, vapor deposition, adhesion or embedded processing process.

3. The keyboard backlight module as claimed in claim 1, wherein said high-refractive index particles are selected from an oxide and a nitride so that the high-refractive index scatter points greatly enhances the refraction, reflection or scattering toward the brightness of light source.

4. The keyboard backlight module as claimed in claim 3, wherein said oxide is selected from a group consisting of silica ($SiO_2$), alumina ($Al2O_3$) and titanium dioxide ($TiO_2$); and said nitride is aluminum nitride (AlN).

5. The keyboard backlight module as claimed in claim 3, wherein said high-refractive index particles are in the size range of 0.1~20 μm.

6. The keyboard backlight module as claimed in claim 3, wherein said light-transmissive ink is a colored ink selectively made in yellow, red, blue or green color.

7. The keyboard backlight module as claimed in claim 1, wherein said high-refractive index particles of said high-refractive index scatter points are added to said light-transmissive ink at a ratio about 0.1~50%.

8. The keyboard backlight module as claimed in claim 1, wherein said high-refractive index scatter points are mounted in the opposing top and bottom surfaces of said light guide layer of said backlight device staggered asymmetric relationship.

* * * * *